United States Patent [19]

Iwase et al.

[11] Patent Number: 4,764,098

[45] Date of Patent: Aug. 16, 1988

[54] ROOTS TYPE PUMP WITH PIN CONNECTION FOR PLASTIC COATED ROTOR

[75] Inventors: Takahiro Iwase, Anjo; Hiroyuki Mochizuki, Aichi; Shigenori Tamaki; Nobuo Kobayashi, both of Toyota; Naofumi Masuda, Nagoya; Katsuro Harada, Tajimi, all of Japan

[73] Assignee: Toyota Jidosha Kabushiki Kaisha, Japan

[21] Appl. No.: 878,704

[22] Filed: Jun. 26, 1986

[30] Foreign Application Priority Data

Jul. 26, 1985 [JP] Japan ..... 60-113688[U]

[51] Int. Cl.[4] ..... F04C 18/18; F04C 29/00; B23P 11/00; F16D 1/06

[52] U.S. Cl. ..... 418/152; 418/178; 418/206; 29/156.4 R; 29/525; 403/379

[58] Field of Search ..... 418/152, 178, 205, 206; 403/378, 379; 29/156.4 R, 525, 526 R

[56] References Cited

U.S. PATENT DOCUMENTS

| | | | |
|---|---|---|---|
| 2,337,903 | 12/1943 | Lauck | 418/152 |
| 2,506,491 | 5/1950 | De Boisblanc | 403/379 |
| 3,275,225 | 9/1966 | Schultz | 418/206 |
| 4,086,043 | 4/1978 | Howe | 418/152 |

FOREIGN PATENT DOCUMENTS

| | | | |
|---|---|---|---|
| 177058 | 12/1953 | Austria | 403/379 |
| 3142896 | 8/1982 | Fed. Rep. of Germany . | |
| 59-81793 | 6/1984 | Japan . | |
| 59-165987 | 11/1984 | Japan . | |
| 59-224402 | 12/1984 | Japan | 418/178 |

*Primary Examiner*—John J. Vrablik
*Attorney, Agent, or Firm*—Parkhurst & Oliff

[57] ABSTRACT

A Roots type pump comprising a pair of mating lobed rotors which are supported by rotor shafts, respectively. Each rotor is fixed to the corresponding rotor shaft by a pin forcibly inserted in a through hole provided through the rotor and rotor shaft. The outer surface of each rotor is surrounded by a coating layer of plastic material, at which the through hole has end openings having cross sectional dimensions greater than that of the substantial part of the through hole.

5 Claims, 2 Drawing Sheets

ROOTS TYPE PUMP WITH PIN CONNECTION FOR PLASTIC COATED ROTOR

BACKGROUND OF THE INVENTION

1. Field of the Invention

The present invention relates to a Roots type pump, particularly, one adapted for use as a mechanically driven supercharger in an internal combustion engine.

2. Description of the Related Art

It is well known that a Roots type pump has a pair of mating lobed rotors which synchronously rotate with each other, with a slight clearance therebetween. When the Roots type pump is used as a mechanically driven supercharger in an internal combustion engine, the rotational speed of the rotor varies over a wide range, depending upon the rotational speed of the engine. This tends to cause the rotors to make contact with each other, resulting in noise. In addition, foreign particles may clog the rotors between the slight clearance, resulting in damage to the rotors. To solve these problems, it is known to provide a coating layer of plastic material on the outer surfaces of the rotors (for example, Japanese Unexamined Utility Model Publication No. 59-81793).

A further problem occurs when the plastic coating is applied on the outer surfaces of the rotors, in that the plastic coating becomes detached from the outer surfaces of the rotors. Particularly, the rotors of the Roots type pump have a special cocoon-like shape in cross section, i.e., a lobed long diameter portion along the major axis and a narrow short diameter portion along the minor axis perpendicular to the major axis, which causes the tension on the plastic coating in the direction of the major axis of the rotor through thermal deformation of the plastic coating and the rotor, and thus the coating layer tends to peel away from the rotor at the narrow portions of the rotors.

A further problem occurs when the rotor is fixed to the rotor shaft by a pin (for example, as in Japanese Unexamined Utility Model Publication No. 59-165987), which is generally inserted in a through hole provided through the rotor and transversely extends between the narrow short diameter portions. FIG. 5 of the attached drawings shows an exaggerated view of a portion of a rotor of a Roots pump in which a pin 14 is inserted in a hole in a rotor 2 in the direction indicated by the arrow. When the pin 14 is forcibly inserted in the hole, the inner wall of the hole is deformed, although the extent of the deformation is minute. Nevertheless, further insertion of the pin produces a larger deformation, and when the leading end of the pin has been fully inserted in the hole, the wall of the hole near the opening end thereof is deformed outwardly of the hole and the outer surface of the rotor is pushed up even though the pin does not project from the outer surface of the rotor. This outward deformation, i.e., the bulge in the outer surface of the rotor, causes a corresponding bulge in the coating layer of plastic material 10. The peeling of the coating layer due to the special shape of the rotor, as described above, tends to start at this bulged region, and thus it appears that this bulge in the coating layer may lead to the actual, undesirable peeling of the coating layer.

SUMMARY OF THE INVENTION

It is an object of the present invention to provide a Roots type pump which can solve the above described problems.

According to the present invention, there is provided a Roots type pump comprising a housing, a pair of mating lobed rotors rotatably inserted in the housing, rotor shafts for supporting the rotors, respectively, means for defining a transverse through hole in each of the rotors and the corresponding rotor shaft, and a pin forcibly inserted in the through hole for fixing each rotor to the respective rotor shaft, wherein a coating layer of plastic material is provided on the outer surface of each of the rotors, and the through hole has end openings at the coating layer, both end openings having a cross sectional dimension greater than that of the substantial part of the through hole.

BRIEF DESCRIPTION OF THE DRAWINGS

Further features of the present invention can be understood from the following description of the preferred embodiments and the attached drawings, in which.

DESCRIPTION OF THE PREFERRED EMBODIMENTS

Figure 2:
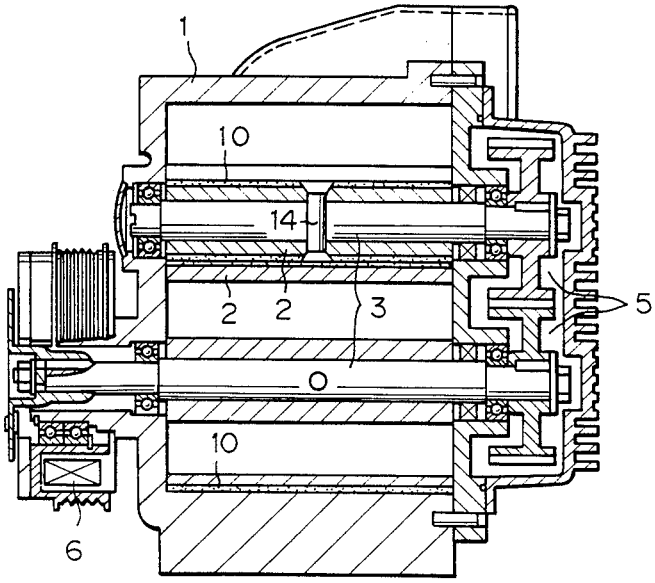
FIG. 2 is a view of a Roots type pump in section according to the present invention.
Figure 3:
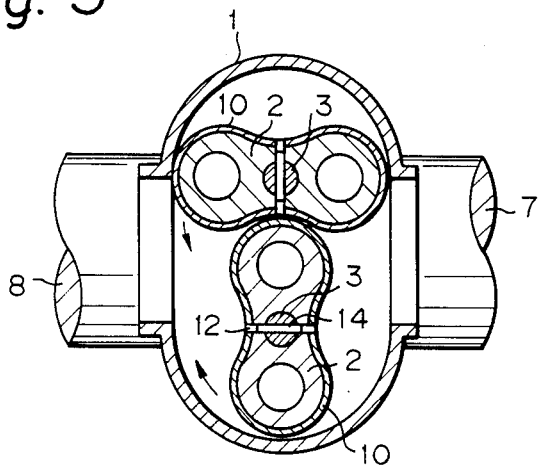
FIG. 3 is a cross sectional view of the Roots type pump of FIG. 2.

FIGS. 2 and 3 show a Roots type pump according to the present invention, comprising a housing 1 in which a pair of mating lobed cocoon-shaped rotors 2 are inserted. The rotors 2 are supported by respective rotor shafts 3. The rotor shafts 3 are mounted at the end plates of the housing 1 by suitable bearings and have at one end thereof (right hand in FIG. 2) identical mating gears 5 fixed thereto. The other end of one rotor shaft 3 has a solenoid clutch 6 fixed thereto, having an input pulley which can be mechanically connected to a crankshaft of an internal combustion engine by a belt or the like. Therefore, the rotors 2 can be driven synchronously with the internal combustion engine, and be rotated in opposite directions to each other, as shown by the arrows in FIG. 3, by the mating gears 5. This Roots type pump can be arranged in an intake air passage of the engine as a mechanically driven supercharger, and has an input port 7 connected to an upstream air cleaner side of the engine and an output port 8 connected to a downstream combustion chamber side thereof.

Figure 1:
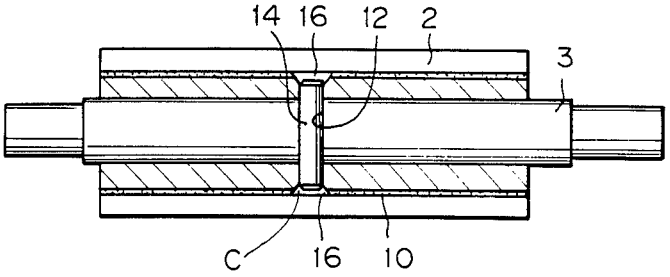
FIG. 1 is a view of a rotor in section and in enlarged scale of a Roots type pump in FIG. 2 according to the present invention.

As shown in FIGS. 1 to 3, each rotor 2 is made from aluminum and a coating layer of plastic material is applied over the outer surface of the aluminum rotor body, the formed coating layer of plastic material being shown by the numeral 10. The coating layer 10 is provided over a whole outer surface of the rotor 2, including a lobed long diameter portion along the major axis of the rotor profile and a narrow short diameter portion along the minor axis perpendicular to the major axis, as shown in FIG. 3. A through hole 12 extends through the narrow short diameter portion of the rotor 2 and the rotor shaft 3 at the center of the length of the rotor 2, and a pin 14 is forcibly inserted in the through hole 12, in an interference fit relationship, to fix the rotor 2 to the rotor shaft 3. The length of the pin 14 is slightly shorter than the length of the through hole 12 between the opposite ends thereof, so that the pin 14 does not project from the outer surface of the rotor 2.

The through hole 12 has opposite end openings 16 at the coating layer 10. Both end openings 16 are chamferred, as shown in FIG. 1, so that each of the end openings 16 has a cross sectional dimension greater than that of the substantial part of the through hole 12, in which the pin 14 is an interference fit. In the preferred example, the thickness of the coating layer 19 is 0.8 mm, and thus, in this case, the amount of chamferring C should be 1.6 mm, i.e., about twice the thickness of the coating layer 10. Therefore, the corner of the through hole of the aluminum body of the rotor 2 is also chamferred during the chamferring of the coating layer 10.

Figure 5:
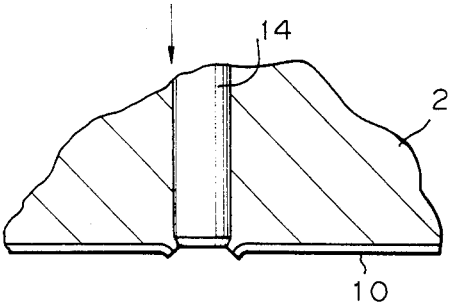
Fig. 5 PRIOR ART
FIG. 5 is a partial view of a rotor for illustrating the problem of the prior art; and, FIG. 6 is also a partial view of a rotor for illustrating the problem of the prior art.
Figure 6:
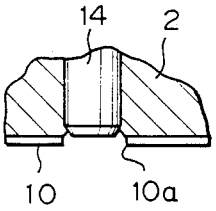
Fig. 6 PRIOR ART

With the above arrangement, when the pin 14 is inserted in the through hole 12 of the rotor 2 and the rotor shaft 3, one spread end opening 16 serves as a guide for insertion of the pin 14 into the through hole 14. The pin 14 is then driven in toward the other end opening 16 by a pressing force, with an accompanying deformation of the inner wall of the through hole, as discussed previously. A minute bulge, such as shown in FIG. 5, may occur at the outer surface of the aluminum body of the rotor 2, caused by the leading end of the pin 14. However, there is no coating material just over the bulged aluminum wall, since the end opening 16 has a greater dimension than that of the through hole 12. Therefore, the coating layer 10 is not bulged by the bulged wall of the rotor 2. In addition, since the chamferring also reaches the aluminum body, a component of the deformation which would otherwise bulge, the outer surface of the rotor 2 is absorbed by the chamferred opening of the body, and thus the bulging of the coating layer 10 becomes very small. The chamferring of both ends of the through hole 12 obviates the deburring operation previously necessary to remove burrs 10a, as shown in FIG. 6, formed during the finishing broach machining of the hole 12 of the plastic coated rotor. Further, by chamferring both ends of the through hole 10, the insertion of the pin 14 is facilitated, that is, the pin 14 can be inserted from either of the end openings 16 of the through hole 12.

Figure 4:
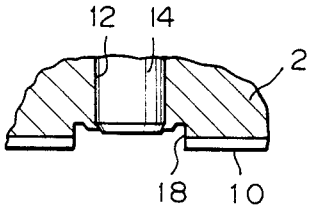
FIG. 4 is a partial view of a rotor in another embodiment.

FIG. 4 shows a rotor of another embodiment according to the present invention. The rotor 2 has a through hole 12 for insertion of a pin 14. One end opening can be chamferred as in the previous embodiment. The other end opening is represented by the numeral 18, and is obtained by spot facing. The end opening 18 has a cross sectional dimension greater than that of the substantial part of the through hole 12 and the spot facing reaches the body of the rotor 2. Therefore, the spot facing can prevent the bulging of the coating layer on the rotor.

It will be understood that the bulging of the coating layer of plastic material when inserting a pin in a hole of a rotor does not occur, according to the present invention, and thus the peeling of the coating layer of plastic material from the rotor is prevented.

We claim:

1. A roots type pump, comprising:
   - a housing;
   - a pair of mating lobed rotors rotatably inserted in said housing, the outer surface of each said rotor including a lobed long diameter portion along the major axis of the rotor profile and a narrow short diameter portion along the minor axis perpendicular to said major axis;
   - a rotor shaft respectively supporting each said rotor;
   - means defining a transverse through hole in each of said rotors and the corresponding rotor shaft, said transverse through hole extending through said narrow short diameter portion of said respective rotor;
   - a coating layer of plastic material on the outer surface of each of said rotors;
   - end openings in each said coating layer at respective ends of said through hole, said end openings extending through said coating layer and extending through the outer surface of the respective rotor;
   - a pin forcibly inserted in each said through hole for fixing each rotor to its respective shaft;
   - wherein each said end opening has a cross-sectional dimension at said coating layer greater than that of said through hole, and a cross-sectional dimension at said rotor outer surface sufficient to substantially absorb bulges and deformations in the rotor caused by forcible insertion of the pin.

2. A roots type pump according to claim 1, wherein said end openings are provided by chamferring.

3. A roots type pump according to claim 2, wherein said chamfering extends through the coating layer and through the rotor outer surface.

4. A roots type pump according to claim 1, wherein said end openings are provided by spot facing.

5. A roots type pump according to claim 4, wherein said spot facing extends through the coating layer and through the rotor outer surface.

* * * * *